US006293598B1

(12) United States Patent
Rusiana

(10) Patent No.: US 6,293,598 B1
(45) Date of Patent: Sep. 25, 2001

(54) PUSH-PULL DOOR LATCH MECHANISM WITH LOCK OVERRIDE

(75) Inventor: Arturo D. Rusiana, Algonquin, IL (US)

(73) Assignee: Architectural Builders Hardware, Elk Grove Village, IL (US)

( * ) Notice: Subject to any disclaimer, the term of this patent is extended or adjusted under 35 U.S.C. 154(b) by 0 days.

(21) Appl. No.: 09/409,547

(22) Filed: Sep. 30, 1999

(51) Int. Cl.[7] ..... E05C 1/06; E05B 65/00; E05B 65/10

(52) U.S. Cl. ..... 292/143; 292/165; 70/91

(58) Field of Search ..... 292/137, 165, 292/169, 169.14, 169.15, 167, 143, 140, 336.3, 359, 358; 70/91, 92

(56) References Cited

U.S. PATENT DOCUMENTS

| | | | | |
|---|---|---|---|---|
| Re. 36,209 | * | 5/1999 | Walls | 292/173 |
| 4,986,583 | * | 1/1991 | Campbell et al. | 292/336.3 |
| 5,403,047 | * | 4/1995 | Walls | 292/173 |
| 5,474,348 | * | 12/1995 | Palmer et al. | 292/339 |
| 5,609,372 | * | 3/1997 | Ponelle | 292/200 |
| 5,730,478 | | 3/1998 | D'Hooge . | |
| 6,131,966 | * | 10/2000 | Hensley et al. | 292/139 |
| 6,196,599 | * | 3/2001 | D'Hooge | 292/165 |

* cited by examiner

*Primary Examiner*—Anthony Knight
*Assistant Examiner*—Matthew E. Rodgers
(74) *Attorney, Agent, or Firm*—Greer, Burns & Crain, Ltd.

(57) ABSTRACT

A push-pull door latch mechanism for latching/unlatching a retractable latch bolt of a latch bolt assembly. The latch mechanism includes a pair of handles, one on either side of a door, each handle having an engagement portion configured to engage a pin on a corresponding first and second rotatable cam. Each cam is provided with a latch bolt assembly engaging portion operably connected to the latch bolt assembly. The first cam further has a locking shoulder configured for selective engagement with a first lock member. A lock coupling operably connects the first lock member with a second lock member such that rotational movement of one of the first and second lock members causes rotational movement of the other of the first and second lock members. A lock knob provided on the interior side of the door is operably connected to the first lock member and facilitates toggling of the first and second lock members between the locked and unlocked positions. An override knob provided on the exterior side of the door is operably connected to the second lock member and facilitates toggling of the first and second lock members between the locked and unlocked positions.

18 Claims, 6 Drawing Sheets

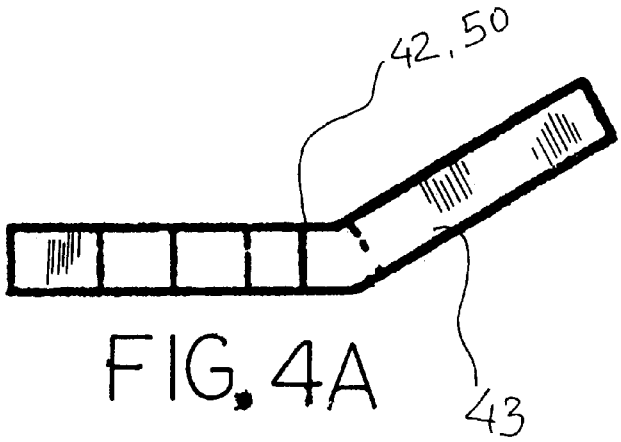
FIG. 4A
FIG. 4B
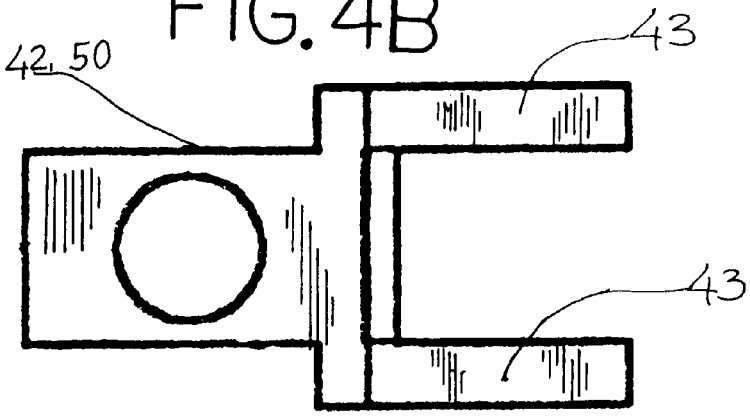

PUSH-PULL DOOR LATCH MECHANISM WITH LOCK OVERRIDE

FIELD OF THE INVENTION

This invention relates to an improved door latch mechanism for a push-pull type door handle, and in particular to an improved lock design for a push-pull door latch mechanism having an override function.

BACKGROUND OF THE INVENTION

Known door latch mechanisms include the traditional rotary type where a door knob is rotated to unlatch a latch bolt, and so-called push-pull types in which a door handle is either pushed or pulled to retract the latch bolt. The push-pull type of door latch mechanisms are particularly suited to high traffic or sanitary environments, such as public restrooms, hospitals, clinics or the like, where it is desirable to unlatch the latch bolt without using ones hands.

It is well known that various infectious diseases are spread through contact with a contaminated surface such as a door handle or similar frequently contacted surface. Thus, it would be particularly advantageous to be able to open a door after washing ones hands without having to use ones hands because touching the door handle partially negates the beneficial effect of hand washing. The demand for such a device is particularly acute in facilities open to the general public such as in commercial or institutional settings.

Particularly in the case of hospitals, clinics, rehabilitation centers, nursing homes and similar facilities, it is further desirable to equip such a door latch mechanism with an integral locking mechanism including a lock override. Notably, it is desirable to temper the desire for privacy with the somewhat conflicting need to provide access to the occupant in the event of an emergency. Thus, what is truly required is a lock which prevents accidental intrusion while facilitating reasonable ease in overriding the lock in the event of an emergency.

One such door latch mechanism is disclosed in U.S. Pat. No. 5,403,047 which patent is hereby incorporated by reference. In the '047 patent, locking is obtained by interference with the push/pull action of the door handle. However, the door latch mechanism disclosed in the '047 patent contains several disadvantages. One disadvantage relates to the complexity of the door locking mechanism and the large number of parts required.

Consequentially, a first object of the present invention is to provide an improved push-pull latch mechanism including a latch mechanism and an override switch which utilizes a relatively simple construction.

A second object of the invention is to provide an improved push-pull latch mechanism which provides a more robust construction.

A third object of the invention is to provide an improved push-pull latch mechanism having component parts configured to facilitate interchangeability.

A fourth object of the invention is to provide an improved push-pull latch mechanism including a lock knob configured to be located on either interior or exterior sides of the door by merely interchanging the latch covers.

SUMMARY OF THE INVENTION

The above-listed objects are met or exceeded by the present push-pull door latch mechanism having a lock override feature. One feature of the invention relates to the use of a simple cam engaging lock, which enhances ease of assembly and is also relatively durable. Further, the design of the door latch mechanism of the present invention eliminates the need for a separate lock bolt, as privacy is maintained by preventing inadvertent actuation of the latch bolt.

Specifically, the present invention provides a push/pull door latch mechanism for laterally unlatching a retractable latch bolt of a latch bolt assembly, the latch mechanism including a first door handle provided on an interior side of a door, and a second door handle provided on an exterior side of the door. The first door handle acts upon a rotatable first cam. The first cam has a locking shoulder, a pin configured for engagement with the engagement portion of the first door handle, and a latch bolt assembly engaging portion operably connected to the latch bolt assembly.

In like manner, the second door handle acts upon a second rotatable cam. The second cam has a pin configured for engagement with the engagement portion of the second door handle, and a latch bolt assembly engaging portion operably connected to the latch bolt assembly.

First and second lock members are provided, each being configured for rotation between locked and unlocked positions, where in the locked position, the first lock member is rotated into engagement with the locking shoulder of the first cam. A lock coupling operably connects the first lock member and the second lock member such that rotational movement of one of the first and second lock members causes rotational movement of the other of the first and second lock members.

A lock knob is provided on the interior side of the door, the lock knob being operably connected to the first lock member and facilitating toggling of the first and second lock members between locked and unlocked positions. An override knob is provided on the exterior side of the door, and is operably connected to the second lock member which in turn is operably connected to the first lock member. Notably, toggling of the override knob toggles the first and second lock members between the locked and unlocked positions.

Rotation of the lock knob into the locked position causes rotation of the first lock member into engagement with the locking shoulder (of the first cam) and prevents rotation of the first and second cams. Correspondingly, rotation either of the lock knob and the override knob into the unlocked position causes rotation of the first lock member out of engagement with the locking shoulder and permits rotation of the first and second cams, thereby causing the latch bolt assembly to retract the latch bolt.

BRIEF DESCRIPTION OF THE DRAWINGS

FIGS. 4A and 4B are views of a fork shaped member according to the present invention.

DETAILED DESCRIPTION OF THE PREFERRED EMBODIMENT

Figure 1A:
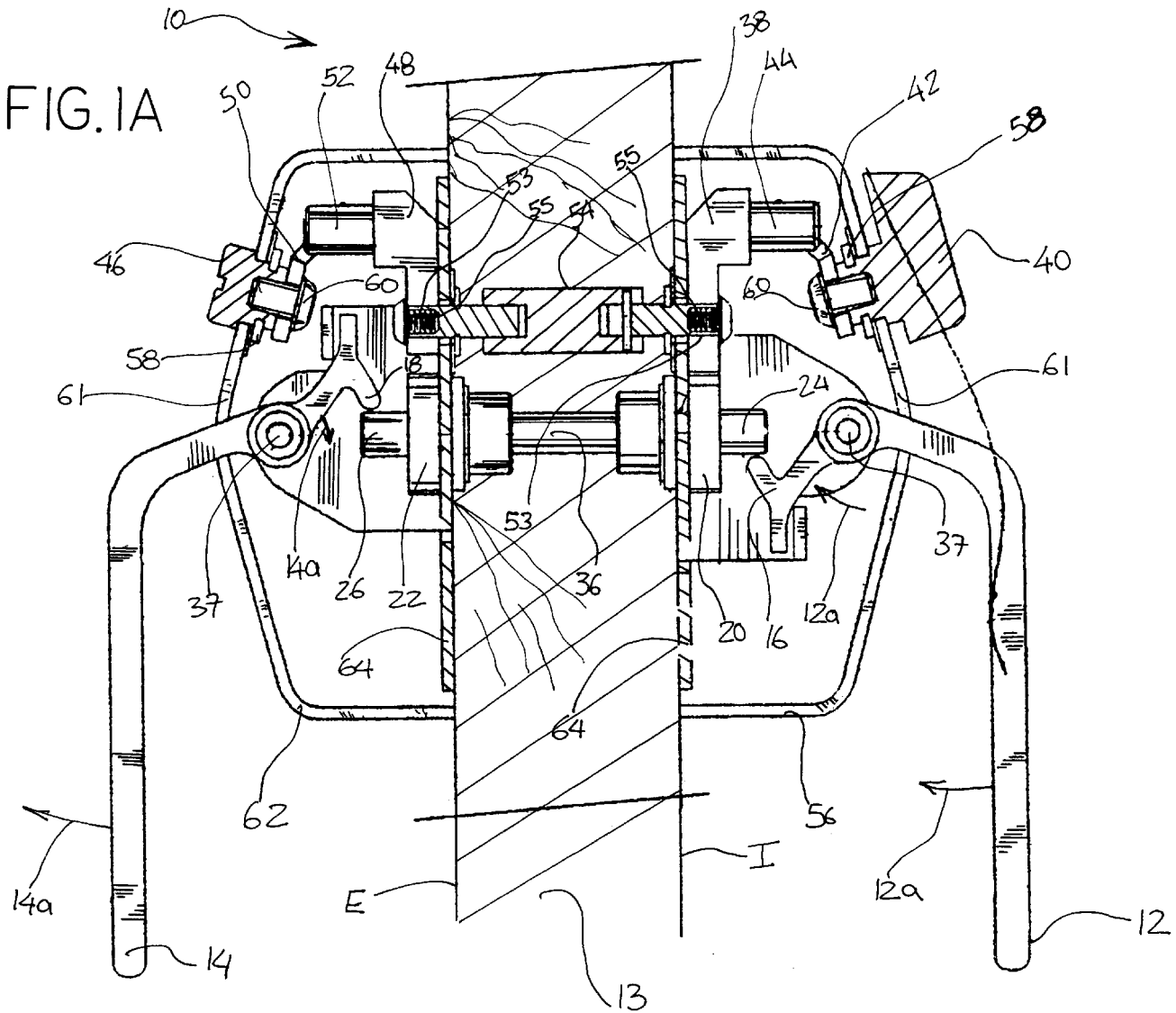
FIG. 1A is a side elevational view of the push-pull door latch mechanism of the present invention with portions shown cut away for clarity.
Figure 1B:
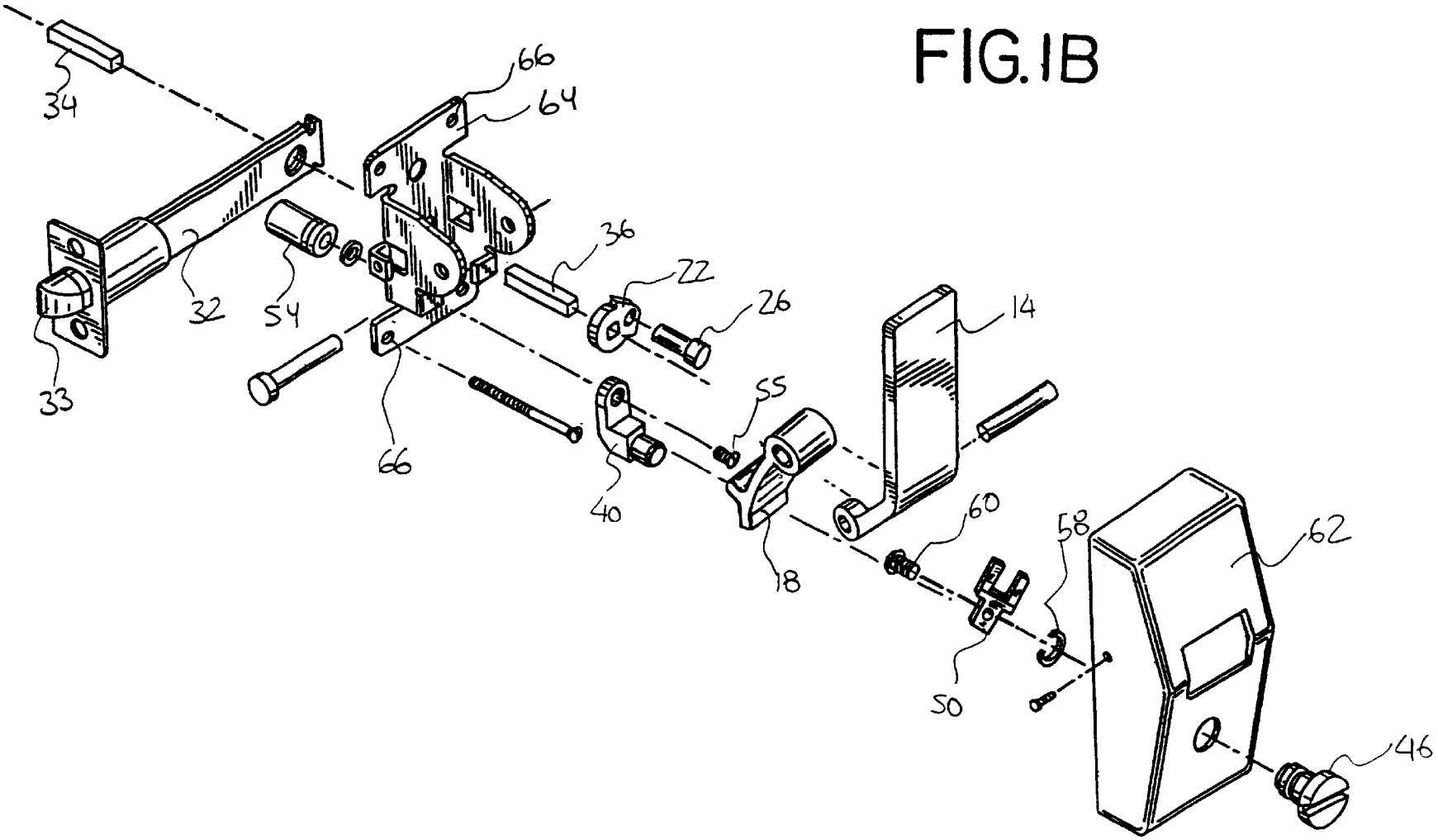
FIGS. 1B and 1C are a partial exploded views of the push-pull door latch mechanism of FIG. 1A.
Figure 1C:
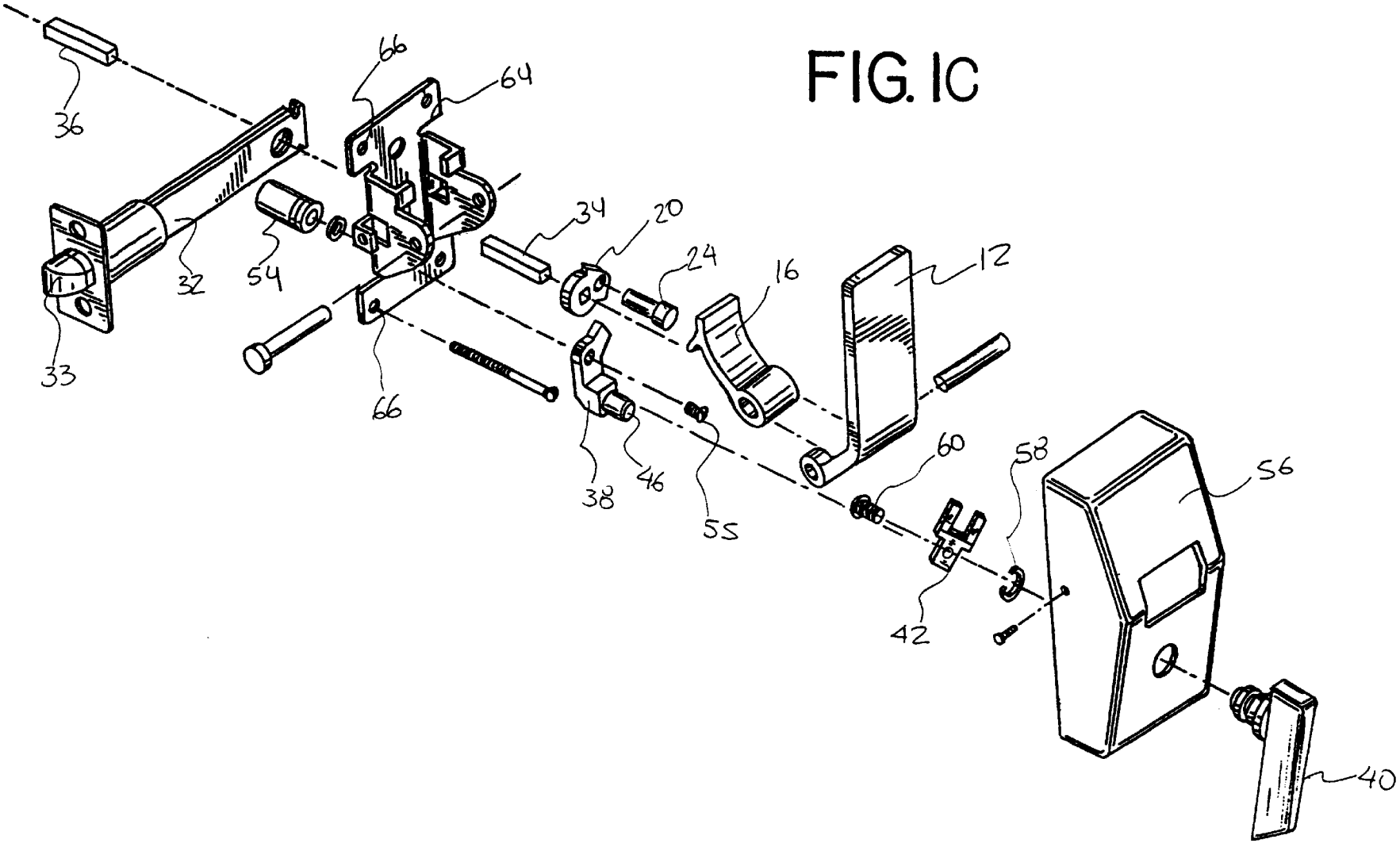

Referring now to FIGS. 1A–1C, a preferred embodiment of the present push-pull door latch mechanism is generally designated 10. As shown in FIGS. 1A–1C, the mechanism 10 includes a first door handle 12 provided on an interior side I of a door 13, and a second door handle 14 provided on an exterior side E of the door. The first door handle 12 is provided with an engagement portion 16, and the second door handle 14 is provided with an engagement portion 18.

Figure 2:
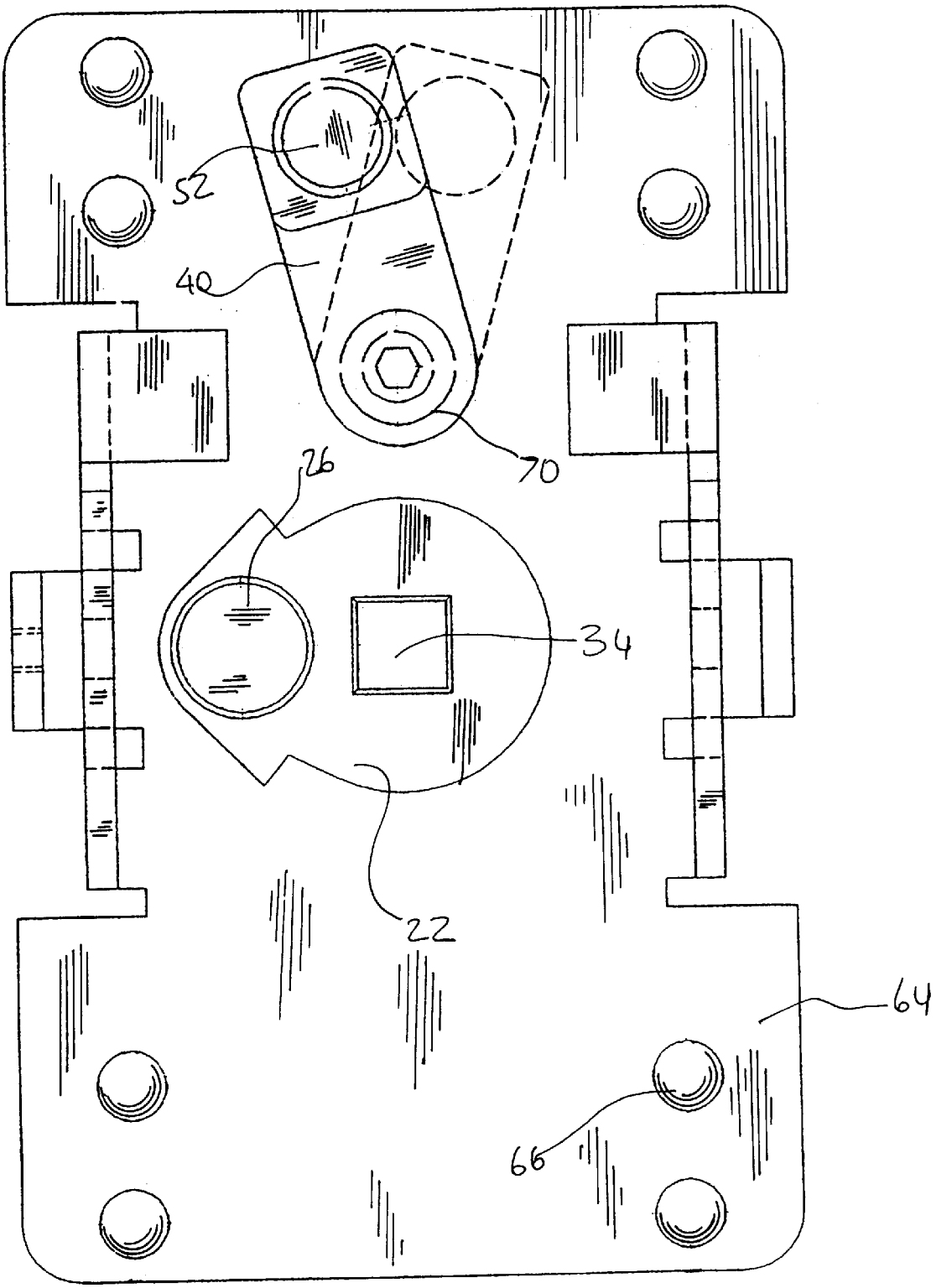
FIG. 2 is a fragmentary frontal view of the present latch mechanism.
Figure 3:
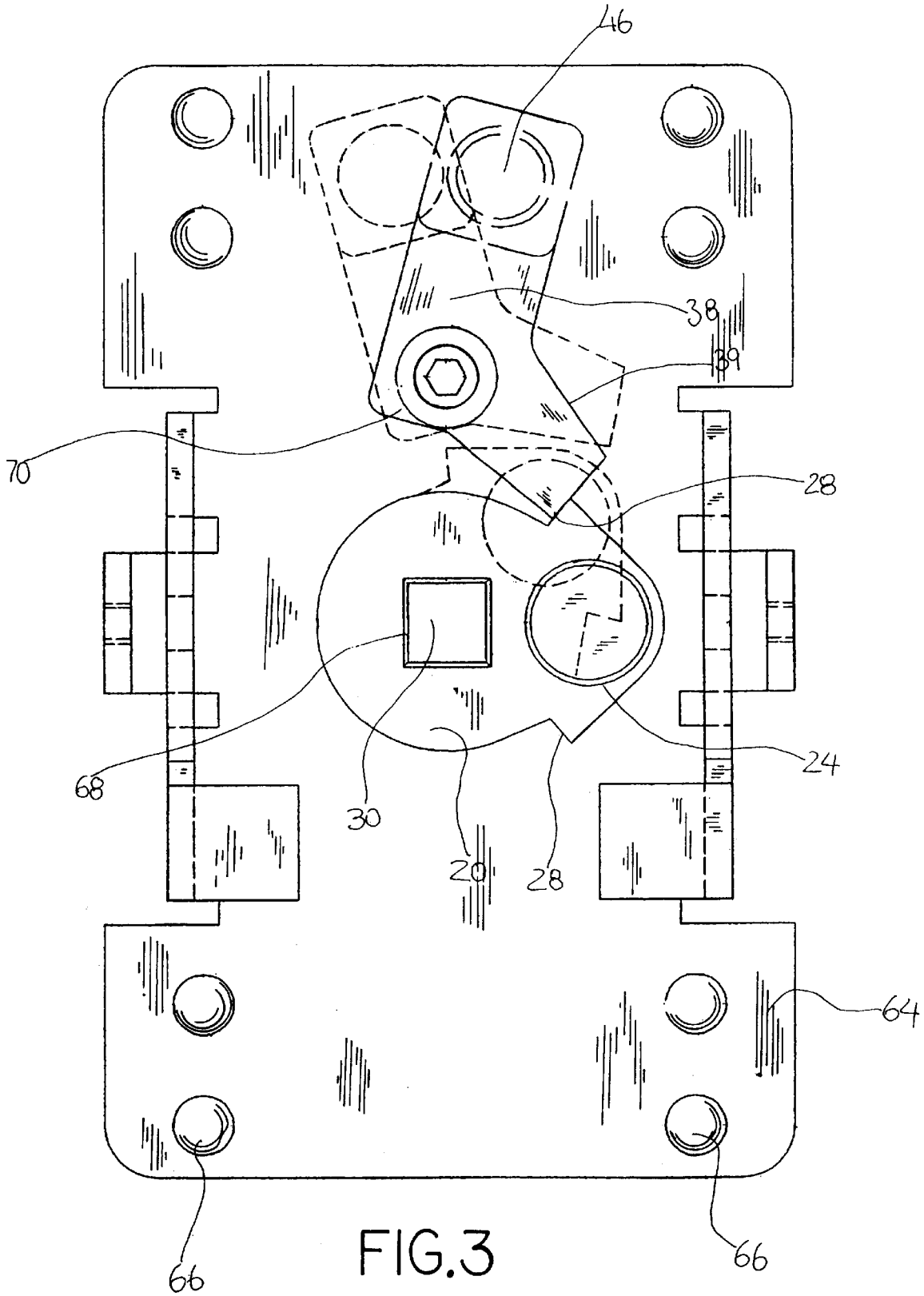
FIG. 3 is a fragmentary frontal view of another portion of the present latch mechanism.

Each engagement portion 16, 18 is configured to engage a corresponding rotary cam 20, 22. Notably, the engagement portion 16 is configured to engage a pin 24 on the cam 20, and the engagement portion 18 is configured to engage a pin 26 on the cam 22. As shown in FIG. 2, the cam 20 is provided with at least one and preferably a pair of locking shoulders 28, and a latch bolt assembly engaging portion 30 which is operably connected to a conventional spring biased latch bolt assembly (not shown). As shown in FIG. 3, the cam 22 is also provided with a latch bolt assembly engaging portion 34 which is operably connected to the conventional latch bolt assembly. The latch bolt assembly does not form part of the invention and is described in detail in U.S. Pat. No. 5,403,047, incorporated by reference.

According to a preferred embodiment, the cam 20 and the cam 22 are interchangeable. However, as will later become apparent, the cam 22 need not be provided with a locking shoulder 28.

Referring again to FIGS. 1A–1C shaft 36 connects the cams 20 and 22. Notably, respective ends of the shaft 36 are partially received within the respective latch bolt assembly engaging portions 30, 34. The shaft 36 is operably connected to the latch bolt assembly such that rotational movement of the shaft causes the latch bolt to retract. Preferably, the ends of the shaft 36 are keyed to prevent relative movement between the latch bolt assembly engaging portions 30, 34 and the shaft 36 such that rotation of one of the cams 20, 22 causes rotation of the other of the cams 20, 22. According to a preferred embodiment, the latch bolt engaging portions 30, 34 have a square opening, and the ends of shaft 36 are configured to have a similar cross-section so as to provide a snug fit. However, one of ordinary skill in the art will appreciate that connection between the shaft 36 and the respective cams 20, 22 may be accomplished using other polygonal configurations, a pair of bolts, or other known coupling configurations.

Although omitted from FIGS. 1A–1C for the sake of clarity, each of the handles 12, 14 are provided with a biasing mechanism, such as a spring or the like, for biasing the respective door handles in a latched position. Thus, one biasing mechanism urges the handle 12 away from the door 13, and another biasing mechanism urges the handle 14 towards the door 13. Likewise, the latch bolt assembly includes a biasing mechanism which urges the latch bolt into an extended position.

Referring again to FIG. 1A, rotational force is transmitted to the cams 20, 22 by actuation of the respective door handles 12, 14. In the preferred embodiment, the door handle 12 is a push-type handle and door handle 14 is a pull-type handle, however it is contemplated that this orientation may be reversed depending on the application. Pushing the door handle 12 towards the door 13 causes the handle to pivot about a pivot axis 37 in the direction of the arrows 12a such that the engagement portion 16 is moved in an upward direction into engagement with the pin 24, thereby causing the cam 20 to rotate in a clockwise direction. The rotational movement of the cam 20 is transmitted via the shaft 34 to the latch bolt assembly 32, and causes the latch member 33 to retract, thereby unlatching the door.

The door handle 14 is configured as a pull-type handle such that pulling the door handle 14 away from the door 13 causes the handle to pivot about a pivot axis 37 in the direction of the arrows 14*a* such that the engagement portion 18 is moved in an downward direction into engagement with the pin 26, thereby causing the cam 22 to rotate in a counter-clockwise direction. The rotational movement of the cam 22 is transmitted via the shaft 36 to the latch bolt assembly 32, and causes the latch member 33 to retract, thereby unlatching the door.

Each of the door handles 12, 14 depicted in FIG. 1 has a horizontal axis of rotation 37. However, one of ordinary skill in the art will appreciate that the rotational axis of the door handle can be easily rotated 90° to provide a vertical axis of rotation.

The privacy feature of the present invention utilizes a lock member 38 to inhibit actuation of the door handles 12, 14. Specifically, the lock member 38 (best seen in FIG. 2) is configured to engage the locking shoulder 28 of the cam 20 in a locked position, thereby preventing rotational movement of the cam 20. More particularly, a lug 39 extends at an approximately 120 degree angle relative to a longitudinal axis of the main body portion of the lock member 38, and is configured to engage the locking shoulder 28 of the cam 20 in the locked position. By manner of illustration, FIG. 2 shows the lock member 38 in the locked position (solid lines) and in the unlocked position (dashed lines). It will be seen that the lock lug 39 and the cam 20 are dimensioned so that, in the unlocked position (shown in phantom), the cam 20 and the shoulder 28 rotate free of engagement with the lug.

As shown in FIG. 1, a lock knob 40 is provided on the interior side I of the door 13, and is operably connected to the lock member 38 by way of a fork-shaped member 42 having a pair of spaced, parallel tines 43 (best seen in FIGS. 4A and 4B) such that rotational movement of the lock knob 40 is transmitted through the fork shaped member 42 to the lock member 38. Thus, the lock member 38 is toggled between locked and unlocked positions by rotating the lock knob 40. More particularly, the lock member 38 is equipped with a lock pin 44 which projects normally from the generally planar surface of the lock member 38 and is positively engaged by the fork-shaped member 42.

It should be noted that the design of the privacy feature of the present invention is an important aspect which contributes toward the robust construction and ease of assembly. Notably, the lock member 38 prevents accidental unlatching of the latch bolt by acting directly on the cam 20 and preventing rotation thereof. Moreover, since the cam 20 is linked with the cam 22 via the shaft 36 of the latch bolt assembly 32, rotational movement of both cams 20, 22 is inhibited by locking one of the cams 20, 22.

Another important aspect of the present invention is the lock override feature. A lock override knob 46 is provided on the exterior side E of the door 13, and is operably connected to a lock member 48 by way of a fork-shaped member 50 having a pair of spaced, parallel tines 43, best seen in FIGS. 4A and 4B, such that rotational movement of the override knob 46 is transmitted through the fork shaped member 50 to the lock member 48. More particularly, the lock member 48 is equipped with a lock pin 52 which projects normally from the generally planar surface of the lock member 48 and is positively engaged by the fork-shaped member 50.

According to a preferred embodiment, the lock pins 44, 52 are substantially similar, each having a generally cylindrical shape.

The lock member 48 is integrally connected to the lock member 38 by a lock coupling 54 such that rotational movement of one of the lock members 38, 48 results in rotational movement of the other of the lock members 38, 48. According to one embodiment, the lock members 38 and 48 each have a through hole 53 which is configured to engage the lock coupling 54. Notably, the ends of the lock coupling 54 may be keyed with respect to the through hole, thereby preventing relative movement between the lock coupling 54 and the lock members 38, 48.

According to a preferred embodiment, ends of the lock coupling 54 are counter bored and configured to receive a threaded fastener 55. In particular, the fastener 55 is a bolt used to attach the lock coupling 54 to lock members 38, 40 (best seen in FIG. 1).

Operation of the push-pull door latch mechanism of the present invention will now be explained with reference to the following example. Assuming, for the sake of example, that the lock member 38 is in a locked position with the lug 39 engaged with the locking shoulder 28. See, e.g., FIG. 2. There are two distinct ways to move the lug 39 into the unlocked position. Typically, the user will simply rotate the lock knob 42 in order to move the lug 39 into the unlocked position. If, however, emergency access is required from the exterior side, the lug 39 can be moved into the unlocked position by rotating the override knob 46 (best seen in FIG. 1).

To prevent inadvertent over-riding of the lock, the override knob 46 is designed to appear as an ordinary fastening screw. Like a typical screw, the override knob 46 has a slotted head configured to accommodate a small coin, a screwdriver or the like. Thus, while no special key is required to actuate the override knob 46, the inconspicuous design prevents inadvertent over-riding of the lock.

As shown in FIG. 1 the lock knob 40 is attached to a cover 56 by a retaining clip 58, and the fork shaped member 42 is attached to the lock knob 40 by a threaded fastener 60. Further, as shown in FIG. 1 the override knob 46 is attached to a cover 62 by a retaining clip 58, and the fork shaped member 50 is attached to the override knob 46 by a threaded fastener 60. Each of the covers 56, 62 is provided with a transverse slot 61 dimensioned to accommodate the pivoting action of the handles 12, 14

In the embodiment depicted in FIG. 1, the door handle 12 is configured as a push-type handle wherein the latch bolt is retracted by pushing on the handle 12, and the door handle 14 is configured as a pull-type handle wherein the latch bolt is retracted by pulling on the handle 14. One of ordinary skill in the art will appreciate that the direction in which the door 13 opens (inward, outward) dictates the which type of handle 12, 14 will be mounted on the interior or exterior surface of the door 13. Obviously, if the door opens inward then it would be desirable to mount a pull-type handle 14 on the interior side of the door.

Additionally, in the embodiment depicted in FIG. 2, the lug 39 interacts with the cam 20 on the push-side of the door. However, one of ordinary skill in the art will appreciate that the lock members 38 and 48 could be interchanged such that the lug 39 interacts with the cam 22 on the pull-side of the door. Moreover, in the embodiment depicted in FIGS. 1A–1C and 2, the lock knob 40 is provided on the push-side of the door, and the override knob 46 is provided on the pull-side of the door. However, the design of the present invention facilitates interchangeability of the lock and override knobs simply by exchanging the cover plates 56, 62 including the respective knobs 40, 46 and the respective fork shaped members 42, 50.

According to one refinement of the present invention, the cam 20 and the cam 22 are interchangeable, thereby facilitating a reduction in the number of unique parts. According to another refinement, the cam pins 24, 26 extend normally from a generally planar surface of the first and second cams 20, 22.

Referring now to FIGS. 1 and 2, a mounting plate 64 is a generally flat plate, one of which is mounted to each of the interior and exterior surfaces of the door 13, and is provided with plural mounting holes 66 used to attach the mounting plate 64 to the door 13. The mounting plate 64 further defines an opening 68 configured to receive the shaft 36 and at least one opening 70 to receive the lock coupling 54.

While various embodiments of the present push pull door lock mechanism with override feature have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

What is claimed is:

1. A push-pull door latch mechanism for latching/unlatching a retractable latch bolt of a latch bolt assembly, said latch mechanism comprising:

a first door handle provided on an interior side of a door, and having an engagement portion;

a second door handle provided on an exterior side of said door, and having an engagement portion;

a first rotatable cam having a locking shoulder, a pin configured for engagement with said engagement portion of said first door handle, and a latch bolt assembly engaging portion operably connected to the latch bolt assembly;

a second rotatable cam having a pin configured for engagement with said engagement portion of said second door handle, and a latch bolt assembly engaging portion operably connected to the latch bolt assembly;

a first lock member configured for rotation between locked and unlocked positions, wherein in said locked position said first lock member is rotated into engagement with said locking shoulder of said first cam;

a second lock member configured for rotation between locked and unlocked positions;

a lock coupling operably connecting said first lock member and said second lock member such that rotational movement of one of said first and second lock members causes rotational movement of the other of said first and second lock members;

a lock knob provided on said interior side of said door, said lock knob being operably connected to said first lock member and facilitating toggling of said first and second lock members between said locked and unlocked positions;

an override knob provided on said exterior side of said door, said override knob being operably connected to said second lock member and facilitating toggling of said first and second lock members between said locked and unlocked positions;

wherein rotation of said lock knob into said locked position causes rotation of said first lock member into engagement with said locking shoulder and prevents rotation of said first and second cams;

wherein rotation of one of said lock knob and said override knob into said unlocked position causes rotation of said first lock member out of engagement with said locking shoulder thereby permitting rotation of said first second cams;

wherein rotation of at least one of said first and second cams causes the latch bolt assembly to retract the latch bolt.

2. The push-pull latch mechanism of claim 1, wherein a rotational axis of said first door handle is perpendicular to a rotational axis of said first cam, and rotational movement of said first cam is translated by said latch bolt assembly into linear motion of said latch bolt such that pushing on said first door handle toward the planar surface of said door causes said latch bolt to retract; and a rotational axis of said second door handle is perpendicular to a rotational axis of said second cam, and rotational movement of said second cam is translated by said latch bolt assembly into linear motion of said latch bolt such that pulling on said second door handle away from the planar surface of said door causes said latch bolt to retract.

3. The push pull latch mechanism of claim 1, wherein said latch bolt assembly engaging portion of said first cam is a first through hole;

said latch bolt assembly engaging portion of said second cam is a second through hole;

said first and second cams are operably connected to the latch bolt assembly by a shaft configured to positively engage said first and second through holes.

4. The push pull latch mechanism of claim 3, wherein said first and second ends of said shaft are keyed with respect to said first and second through holes and prevent relative rotation between a respective one of said first and second cams and said shaft.

5. The push pull latch mechanism of claim 1, wherein said first cam and said second cam are interchangeable.

6. The push pull latch mechanism of claim 1, wherein said cam pin of said first and second cams extends normally from a generally planar surface of said first and second cams.

7. The push pull latch mechanism of claim 1, wherein said first lock member has a lug which extends from a main body portion of said first lock member and is configured to engage said locking shoulder of said first cam in said locked position thereby preventing rotation of said first and second cams, said lug being configured to be rotated out of engagement with said locking shoulder of said first cam in said unlocked position thereby permitting rotation of said first and second cams.

8. The push pull latch mechanism of claim 7, wherein said lug extends at approximately a 120 degree angle relative to a longitudinal axis of said main body portion.

9. The push pull latch mechanism of claim 7, further comprising:

a first lock pin projecting normally from a planar surface of said first lock member; and a second lock pin projecting normally from a planar surface of said second lock member.

10. The push pull latch mechanism of claim 9, wherein said first lock pin is generally cylindrical, and is configured for engagement with said lock knob; and said second lock pin is generally cylindrical, and is configured for engagement with said override knob.

11. The push pull latch mechanism of claim 10, further comprising:

a first fork shaped member operably connected to said lock knob and configured for engagement with said first lock pin.

12. The push pull latch mechanism of claim 11, further comprising:

a second fork shaped member operably connected to said override knob and configured for engagement with said second lock pin.

13. The push pull latch mechanism of claim 1, wherein said first lock member has a through hole;

said second lock member has a through hole;

said lock coupling includes a lock shaft having first and second ends configured to positively engage said through holes of said first and second lock members.

14. The push pull latch mechanism of claim 13, wherein said first and second ends of said lock shaft are counter bored;

a first bolt at least partially received within each of said through hole of said first lock member and said first counter bored end of said lock shaft;

a second bolt at least partially received within each of said through hole of said second lock member and said second counter bored end of said lock shaft.

15. The push pull latch mechanism of claim 14, wherein said first and second counter bored ends of said lock shaft are keyed with respect to said first and second bolts and prevent relative rotation between said first and second bolts and said lock shaft.

16. The push pull latch mechanism of claim 1, wherein said override knob has a keyed face configured to receive one of a screw driver and a small coin to facilitate rotation of said override knob.

17. The push pull latch mechanism of claim 1, further comprising a mounting plate configured for attachment to at least one of said interior and exterior surfaces of said door, said mounting plate including at least one passage configured to receive said cam coupling and said lock coupling.

18. The push pull latch mechanism of claim 1, further comprising:

a first cover, said lock knob and said first lock member being operably connected to said first cover;

a second cover, said override knob and said second lock member being operably connected to said second cover;

wherein said first and second covers are interchangeable such that said lock knob and said override knob may be positioned on either of said interior and exterior side of the door.

* * * * *